United States Patent [19]

Champagne

[11] Patent Number: 4,958,867

[45] Date of Patent: Sep. 25, 1990

[54] LOCKING DEVICE FOR WASHERS AND DRYERS

[76] Inventor: Phillip A. Champagne, 16650 SE. Bel-Air Dr., Clackamas, Oreg. 97015

[21] Appl. No.: 473,021

[22] Filed: Jan. 31, 1990

[51] Int. Cl.[5] ..... E05C 19/18

[52] U.S. Cl. ..... 292/259 R; 292/258; 292/303; 292/DIG. 69

[58] Field of Search ..... 292/258, 259, 278, 288, 292/339, DIG. 69, 267, 270, 274, 303, 304

[56] References Cited

U.S. PATENT DOCUMENTS

| | | | |
|---|---|---|---|
| 1,711,282 | 4/1929 | Orr | 292/267 |
| 2,846,257 | 8/1958 | Sherrill | 292/258 |
| 3,245,239 | 4/1966 | Zaidener | 70/202 |
| 3,475,929 | 11/1969 | Weingart | 70/14 |
| 3,664,164 | 5/1972 | Zaidener | 70/202 |
| 4,200,317 | 4/1980 | Polselli et al. | 292/293 |
| 4,286,412 | 9/1981 | Stevens | 292/270 X |
| 4,486,042 | 12/1984 | Chee | 292/304 X |

FOREIGN PATENT DOCUMENTS

| | | | |
|---|---|---|---|
| 397845 | 7/1924 | Fed. Rep. of Germany | 292/259 |
| 657739 | 1/1929 | France | 292/267 |
| 987770 | 4/1951 | France | 292/258 |
| 17224 | 12/1898 | Switzerland | 292/267 |

*Primary Examiner*—Lloyd A. Gall

*Attorney, Agent, or Firm*—Henderson & Sturm

[57] ABSTRACT

A washer/dryer lock device (10) to be used in both front loading (101) and top loading (102) machines, wherein the device comprises a sleeve member (14) dimensioned to receive a toothed shaft member (18) and an over-center spring biased lock unit (13) attached to the sleeve member (14) and adapted to releasably engage the shaft member (18) such that a flange element (15) on the sleeve member (14) and a friction pad element (21) on the shaft member (18) can engage opposed surfaces on a machine (101) (102) so as to prevent the machine door (100) from being opened.

8 Claims, 2 Drawing Sheets

LOCKING DEVICE FOR WASHERS AND DRYERS

TECHNICAL FIELD

This invention relates to locking devices in general and more particularly to devices for the locking of washers and dryers.

BACKGROUND OF THE INVENTION

As can be seen by reference to the following U.S. Pat. No's: 3,245,239; 3,664,164; 3,475,929; and 4,200,317, the prior art is replete with myriad and diverse locking mechanisms.

While the prior art constructions are more than adequate for the basic purpose and function for which they were specially designed, they do not address the specialized problem of locking a washer or dryer.

As anyone who does not own their own personal washer or dryer is aware, there is a need for a portable locking device to be used on public and/or pay washers and dryers.

For example, if you live in a dwelling that does not have its own washer and dryer, then you have to do your wash in a community area. Most people when doing their wash in these areas do not monitor their clothes during the washing and drying cycles. Thus the person's clothes are left unattended for a period of time, and are thereby susceptible to theft and tampering. Noting the rising prices of clothing these days the likelihood of theft is becoming even more prevalent.

As a consequence of the foregoing situation there has existed a longstanding need for a portable locking device for use on communal or pay washers and dryers. The provision of such a device is the stated objective of this invention.

SUMMARY OF THE INVENTION

An object of the present invention is to provide a portable locking device suitable for use on both washers and dryers.

Another object of the present invention is to provide a locking device that has length adjustable shaft and sleeve units, which will enable the locking device to accommodate different sized machines.

Still another object of the present invention is to provide a locking device with capturing means for the secure engagement of the washer and/or dryer.

A further object of the present invention is to provide a locking device with a spring biased locking unit which will ensure that the lock is securely engaged with the washer or dryer at all times.

Yet another object of the present invention is the provision of a catch element which cooperates with a padlock for the positive locking engagement of the device.

BRIEF DESCRIPTION OF THE DRAWINGS

These and other objects, advantages, and novel features of the invention will become apparent from the detailed description of the best mode for carrying out the preferred embodiment of the invention which follows; particularly when considered in conjunction with the accompanying drawings, wherein.

BEST MODE FOR CARRYING OUT THE INVENTION

Figure 1:
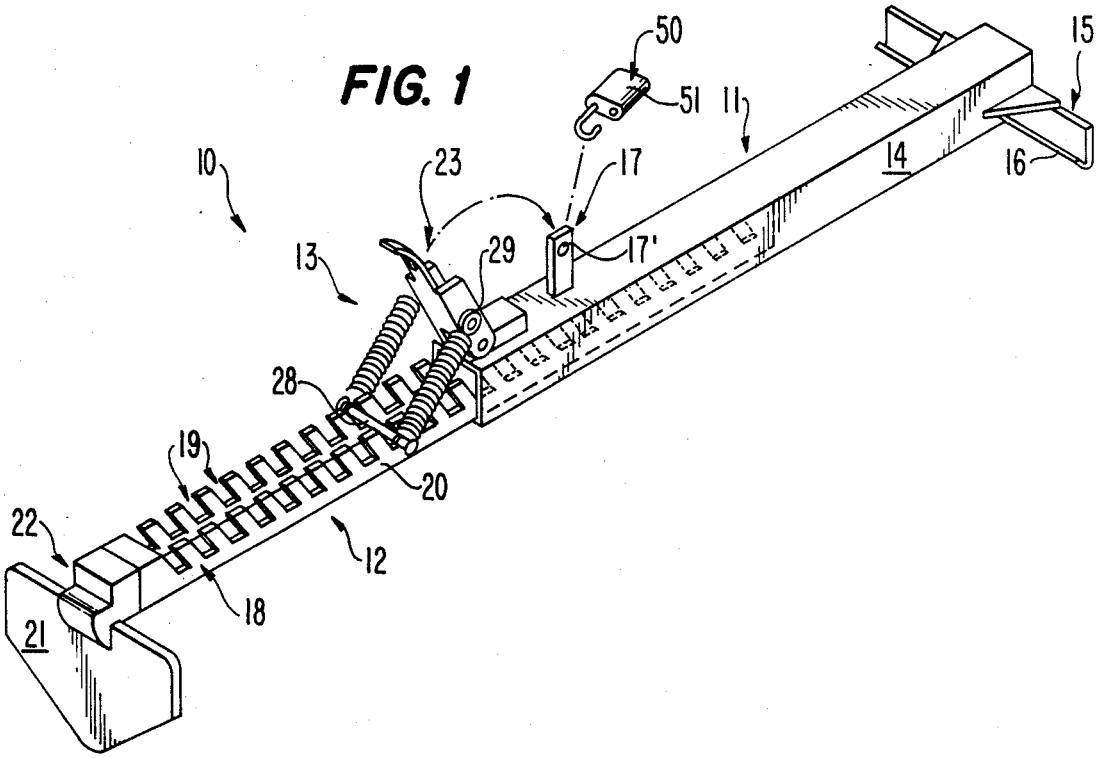
FIG. 1 is a perspective view of the device.

As can best be seen by reference to the drawings and in particular to FIG. 1, the washer/dryer locking device which forms the basis of the present invention is designated generally by the reference numeral (10). The locking device (10) comprises in general: a sleeve unit (11), a shaft unit (12), and a spring biased locking unit (13). These units will now be described in seriatim fashion.

Figure 2:
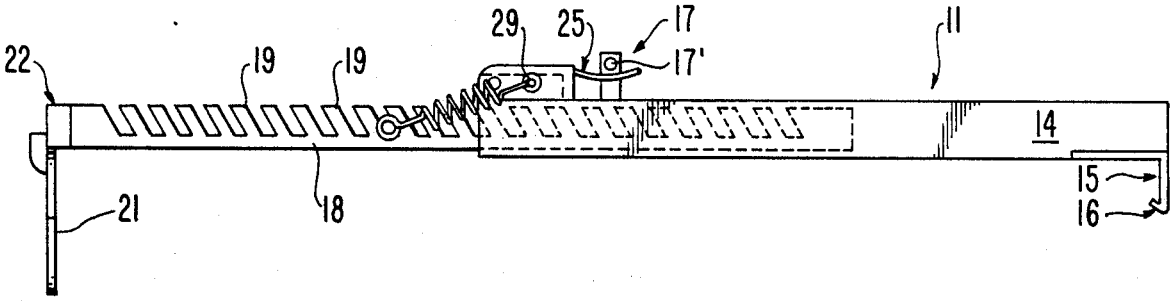
FIG. 2 is a side plan view of the device.
Figure 3:
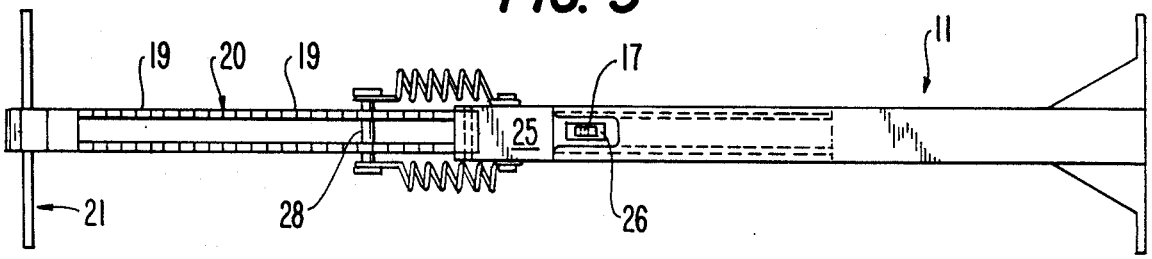
FIG. 3 is a top plan view.

As shown in FIGS. 1 through 3 the sleeve unit (11) comprises an elongated hollow sleeve member (14) having a generally rectangular configuration and a flange element (15) formed on one end. The flange element (15) depends downwardly from, and is rigidly secured to, the sleeve member (14); and is further provided with an upwardly turned lip portion (16) whose purpose and function will be described further on in the specification. In addition the other end of the member (14) is further provided on its top surface with a catch element (17) whose purpose and function will likewise be explained later on in the specification.

Still referring to FIGS. 1 and 3, it can be seen that the shaft unit (12) comprises an elongated toothed shaft member (18) dimensioned to be received within the sleeve member (14) and having a plurality of aligned and opposed angled teeth (19) formed along the sides (20) of the shaft member (18), and a downwardly depending enlarged friction pad element (21) rigidly secured to the outboard end (22) of the shaft member.

Figure 4:
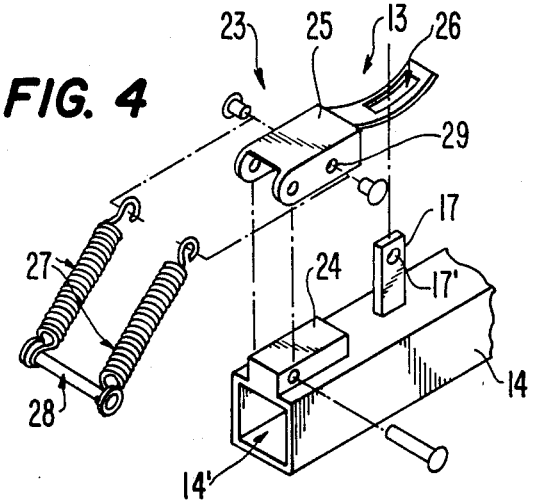
FIG. 4 is an exploded perspective view of the latching mechanism.
Figure 5:
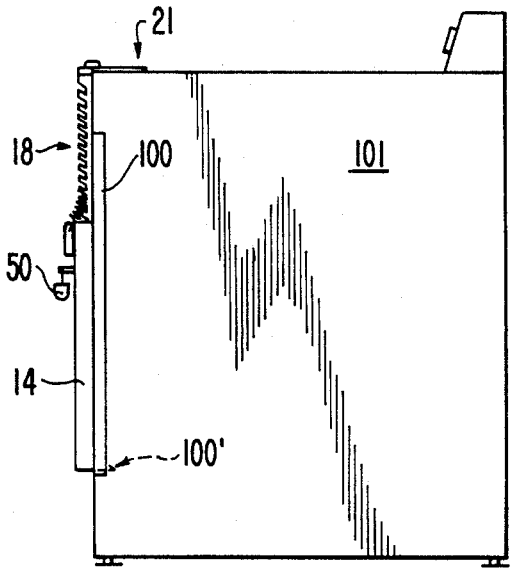
FIG. 5 is a side plan view of the device installed on a front loading machine.
Figure 6:
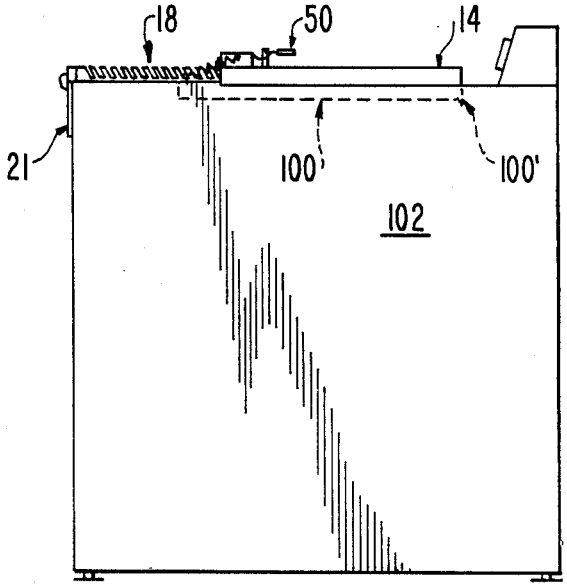
FIG. 6 is a side plan view of the device installed on a top loading machine; and, FIG. 7 is an enlarged detail view of an alternate embodiment of the latching mechanism.

Turning now to FIGS. 1, 2 and 4 it can be seen that the spring biased locking unit (13) comprises a pivoted latch member (23) including a base (24) rigidly secured to the top of the sleeve member (14) and disposed intermediate the mouth (14') of the sleeve member (14) and the catch element (17) and a latch arm (25) pivotally secured to the base (24) and provided with an elongated aperture (26) which in the preferred embodiment of the invention is dimensioned to slip over the catch element (17).

In addition, the locking unit (13) further comprises a pair of spring elements (27), which are operatively attached on one end to a latch rod (28) which is dimensioned to be received in the teeth (19) of the shaft member (18) and which are operatively attached on their other end to opposite sides of the latch arm (25).

Furthermore as can be seen by reference to FIGS. 1, 2 and 4, the operative engagement as at (29) between the latch arm (25) and the spring elements (27) is such as to produce a well recognized over-center spring locking action when the locking unit (13) is engaged as specifically depicted in FIG. 2.

In the preferred embodiment of the invention depicted in FIGS. 1 through 6, the locking device is intended to be operatively engaged across the front of a front loading machine (101) such as a dryer or across the top of a top loading machine (102) such as a washer, wherein the friction pad element (21) is engaged with a machine surface that is disposed perpendicular to the plane of the machine door (100) in its closed position, and wherein the lip portion (16) of the flange element (15) of the sleeve member (14) is engaged with the hinged edge (100') of the machine door (100).

At this juncture the latch arm (25) is rotated in a counter-clockwise direction to position the latch rod (28) intermediate a selected opposed pair of rearwardly angled teeth (19) and then the latch arm (25) is rotated in the clockwise direction against the bias of the spring elements (27) so as to force the spring element (27) into the over-center position depicted in FIG. 2.

Now in order to provide a secure locking engagement of the device (10) relative to the machine (101)(102) a locking means (50) is employed to captively engage the free end of the latch arm (25) relative to the sleeve member (14). In the preferred embodiment the locking means (50) comprises a padlock (51) which is dimensioned to be received in a suitably dimensioned aperture (17') in the catch element (17).

Figure 7:
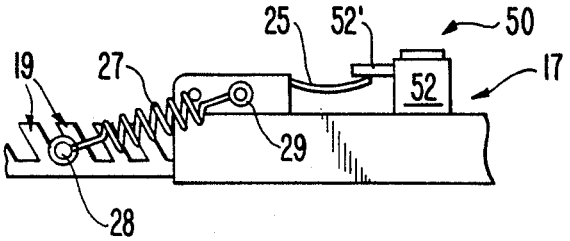

In the alternate embodiment depicted in FIG. 7, the lock means (50) and the catch element (17) are combined into a single structure, wherein the lock means (50) comprises a sliding bolt lock (52) having a reciprocating bolt (52') which can be extended and retracted in a well recognized manner to selectively overlie the free end of the latch arm (25) in the locked position.

Having thereby described the subject matter of the present invention it should be apparent that many substitutions, modifications and variations of the invention are possible in light of the above teachings. It is therefore to be understood that the invention as taught and described herein is only to be limited to the extent of the breadth and scope of the appended claims.

I claim:

1. A washer and dryer lock device for use with both front and top loading washers and dryers having a hinged door wherein the lock device comprises:

a sleeve unit including an elongated hollow sleeve member having a downwardly depending flange element formed on one end and a catch element formed on top of the sleeve member at a location proximate to but spaced from the other end of the sleeve member;

a shaft unit including an elongated toothed shaft member having one end dimensioned to be received in the hollow sleeve member and further provided with a downwardly depending friction pad element secured to the other end of the shaft member; and a lock unit operatively attached to the sleeve unit and provided with a pivoted latch member having a pair of spring elements operatively engaged on one end to the latch member and attached on their other end to a latch rod wherein the latch rod is dimensioned to be releasably received by the toothed shaft member.

2. The lock device as in claim 1 wherein the latch member is adapted to operatively engage the said catch element.

3. The lock device as in claim 2 further comprising:

lock means for captively securing said pivoted latch member to said catch element.

4. The lock device as in claim 3 wherein said latch member comprises:

a base operatively secured to said sleeve member; and a latch arm pivotally secured to said base.

5. The lock device as in claim 4 wherein said latch arm is provided with an elongated aperture on a free end which is dimensioned to receive said catch element; the catch element is provided with a discrete aperture and the lock means comprises a padlock which is dimensioned to be received in said discrete aperture.

6. The lock device as in claim 3 wherein said lock means comprises a sliding bolt lock.

7. The lock device as in claim 6 wherein said lock means and said catch element are combined in the same structure.

8. The lock device as in claim 4 wherein said spring elements are operatively secured to the latch arm of said latch member in an over-center relationship.

* * * * *